US007852274B2

(12) United States Patent
Madden, Jr. et al.

(10) Patent No.: US 7,852,274 B2
(45) Date of Patent: Dec. 14, 2010

(54) COMMUNICATIONS TRAILER

(75) Inventors: W. Frank Madden, Jr., Stone Mountain, GA (US); Bridges W. Smith, Jr., Atlanta, GA (US); Trent Davis, Atlanta, GA (US); Dean Mullin, New Maryland (CA); Joe Brown, Soddy Daisy, TN (US)

(73) Assignee: Rockwell Collins Satellite Communications Systems, Inc., Duluth, GA (US)

( * ) Notice: Subject to any disclaimer, the term of this patent is extended or adjusted under 35 U.S.C. 154(b) by 946 days.

(21) Appl. No.: 11/609,574

(22) Filed: Dec. 12, 2006

(65) Prior Publication Data

US 2008/0055170 A1 Mar. 6, 2008

Related U.S. Application Data

(60) Provisional application No. 60/751,135, filed on Dec. 16, 2005.

(51) Int. Cl.
*H01Q 1/32* (2006.01)

(52) U.S. Cl. ..... 343/713; 343/915; 343/880

(58) Field of Classification Search ..... 343/711, 343/713, 915, 880, 761; 280/29, 204
See application file for complete search history.

(56) References Cited

U.S. PATENT DOCUMENTS

| | | | | |
|---|---|---|---|---|
| 3,377,595 | A * | 4/1968 | Carr et al. | 343/713 |
| 3,940,771 | A * | 2/1976 | Wild | 343/766 |
| 4,309,708 | A | 1/1982 | Sayovitz | |
| 4,856,838 | A | 8/1989 | Reshke et al. | |
| 5,337,062 | A | 8/1994 | Sherwood et al. | |
| 5,554,998 | A | 9/1996 | Sherwood et al. | |

FOREIGN PATENT DOCUMENTS

| | | |
|---|---|---|
| DE | 1836937 | 8/1961 |
| DE | 4126979 | 2/1993 |
| EP | 0370314 | 5/1990 |

OTHER PUBLICATIONS

Endine Webpage dated Dec. 16, 2005, pp. 1-2.
European Search Report Dated Mar. 26, 2007.
European Search Report dated May 25, 2007.

* cited by examiner

*Primary Examiner*—Douglas W Owens
*Assistant Examiner*—Dieu Hien T Duong
(74) *Attorney, Agent, or Firm*—Nelson Mullins Riley & Scarborough, L.L.P.

(57) ABSTRACT

A mobile satellite communication trailer comprising a frame, an antenna assembly coupled to the frame comprising a feed boom, a reflector dish coupled to the feed boom, and at least one bumper coupled to the feed boom intermediate the feed boom and the reflector dish. A shock isolator is positioned intermediate the frame and the feed boom. The mobile satellite system further comprises at least three adjustable stabilizing legs providing rigid support for said antenna assembly when said antenna assembly is in a transmission position, said stabilizing legs being convertible between said transmission position and said transport position, wherein one of said at least three adjustable stabilizing legs is moveably connected to said trailer front portion and at least two of said at least three adjustable stabilizing legs are moveably connected to at least one of said satellite antenna assembly and said trailer frame proximate said satellite antenna assembly.

20 Claims, 13 Drawing Sheets

COMMUNICATIONS TRAILER

CLAIM OF PRIORITY

This application claims priority to U.S. Provisional Patent Application No. 60/751,135, filed Dec. 16, 2005, the entire disclosure of which is incorporated by reference herein.

FIELD OF THE INVENTION

This invention relates to a portable dish antenna and, more particularly, is directed to a ruggedized trailer that can support the antenna.

BACKGROUND OF THE INVENTION

The use of dish-type antennas for transmitting and receiving signals between a ground location and an airborne communications satellite is well-known. Antennas typically have four structural components: a parabolic antenna reflector, an antenna feed boom, an antenna feed, and an antenna pedestal. The parabolic antenna reflector functions much like a parabolic mirror: the reflector collects microwave signals transmitted from an airborne satellite, and reflects the signals toward the antenna feed. The parabolic shape of the reflector operates to focus the microwave signals so that they converge at the reflector's focal point. An antenna feed boom is attached to the base of the reflector, and the boom serves to position the antenna feed at the focal point of the reflector. The antenna feed houses electronics that transmit and receive the microwave signals. Positioning the antenna feed at the focal point of the parabolic reflector allows the antenna feed to receive a focused microwave signal from a transmitting satellite. The antenna pedestal provides rigid structural support to the reflector, feed, and feed boom.

Typically, the antenna reflector should be on the order of 2 to 6 feet in diameter. In order to minimize distortion in transmission and reception, the reflector's parabolic shape must be held to extremely close tolerances. Once the antenna's parabolic dish focuses on the satellite, the antenna must remain focused on the satellite to maintain effective transmission and reception of the signals. Thus, the dish must be very rigid, and the antenna pedestal must also provide a rigid mounting that minimizes movement of the dish antenna due to external forces, such as wind.

When permanently installed in the ground, the antenna pedestal supports the antenna sufficiently to maintain effective transmission and reception. But portable antennas, which can be readily moved from location to location, provide a significant challenge. Portable antennas are frequently used in mobile television broadcast, such live coverage of concerts, sporting events, and news events in remote locations. In the past, antennas have been directly mounted onto the bed of a carrier vehicle, such as a truck or a flat-bed trailer. Mounting the antenna directly to the bed of a trailer or a truck increases the likelihood that the antenna will move during use due to the vehicle suspension's response to external forces acting on the antenna or on the truck bed on which it is mounted. The likelihood of movement increases when the truck or trailer bed also supports an equipment housing. Operators working with the equipment frequently create vibrations, which may be transmitted to the antenna. Mobile antennas must be relatively small and light in order to facilitate quick set-up and tear-down by a minimum of personnel; however minimizing the antenna's size and weight also makes it difficult to securely anchor and stabilize the antenna.

A number of mobile satellite antenna designs are well known in the prior art. However, each design has its shortcomings. In particular, mobile antenna designs that rely on frame-mounted stabilizing arms or outriggers frequently allow vibration and forces imparted upon the frame to be transmitted to the antenna. Additionally, prior designs providing for a collapsible antenna often suffer damage to the reflecting dish, antenna feed and electronic components during off-road transportation. Transporting the antenna over rugged terrain subjects the antenna components to significant jarring and shaking, which may result in breakage or damage. Likewise, the electronics external to the antenna feed, such as amplifiers, decoders, and other components, require protection from damaging forces that may be imparted upon them during transportation. Prior mobile antennas provide frame-mounted electronics cabinets, which house integrated electronics racks. Typically, the electronics racks are mounted to the interior of the electronics cabinets. In this arrangement, severe jarring forces or vibrations that are imparted on the vehicle chassis during transportation are transferred directly to the electronic components, and the components may be damaged or destroyed.

SUMMARY OF THE INVENTION

The accompanying drawings, which are incorporated in and constitute a part of this specification, illustrate one or more embodiments of the invention and, together with the description, serve to explain the principles of the invention.

These and/or other objects are achieved in a preferred embodiment of a mobile satellite communication trailer comprising a frame defining a trailer front portion and a trailer rear portion, an antenna assembly coupled to the frame comprising a feed boom, a reflector dish coupled to the feed boom, and at least one bumper coupled to the feed boom intermediate the feed boom and the reflector dish, where the bumper protectively engages the reflector dish when the antenna assembly is in a transport position. A shock isolator is positioned intermediate the frame and the feed boom. The mobile satellite system further comprises at least three adjustable stabilizing legs providing rigid support for said antenna assembly when said antenna assembly is in a transmission position, said stabilizing legs being convertible between said transmission position and said transport position, wherein one of said at least three adjustable stabilizing legs is moveably connected to said trailer front portion and at least two of said at least three adjustable stabilizing legs are moveably connected to at least one of said satellite antenna assembly and said trailer frame proximate said satellite antenna assembly. An electronics cabinet comprises a frame, at least one equipment rack received by said electronics cabinet frame, and at least one shock absorber positioned intermediate said electronics cabinet frame and said equipment rack for suspending said at least one equipment rack from said electronics cabinet frame.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
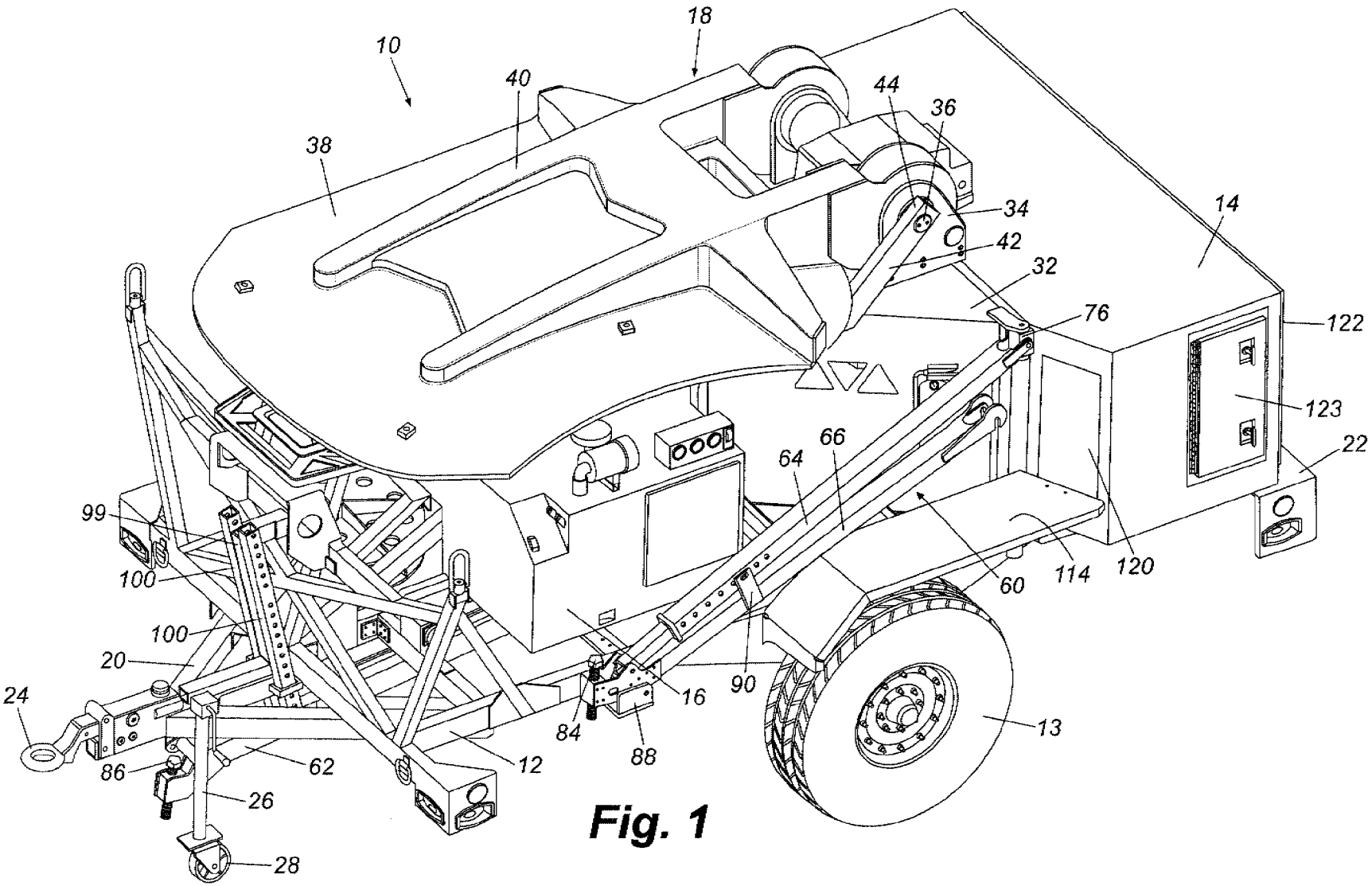
FIG. 1 is perspective view of a mobile satellite trailer in accordance with an embodiment of the present invention, the mobile satellite trailer, shown in a transport mode.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
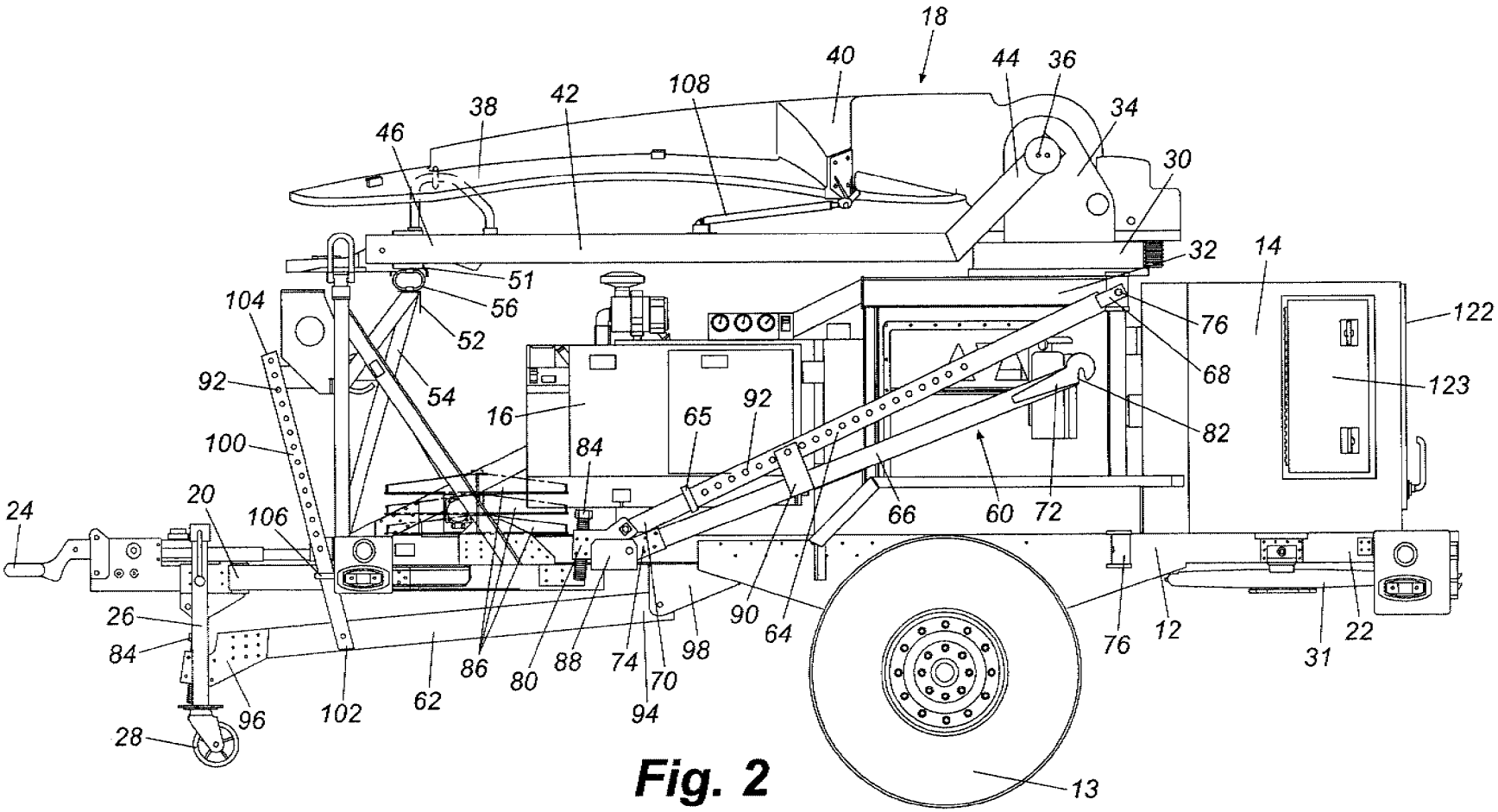
FIG. 2 is a left side elevation view of the mobile satellite trailer shown in FIG. 1.
Figure 3:
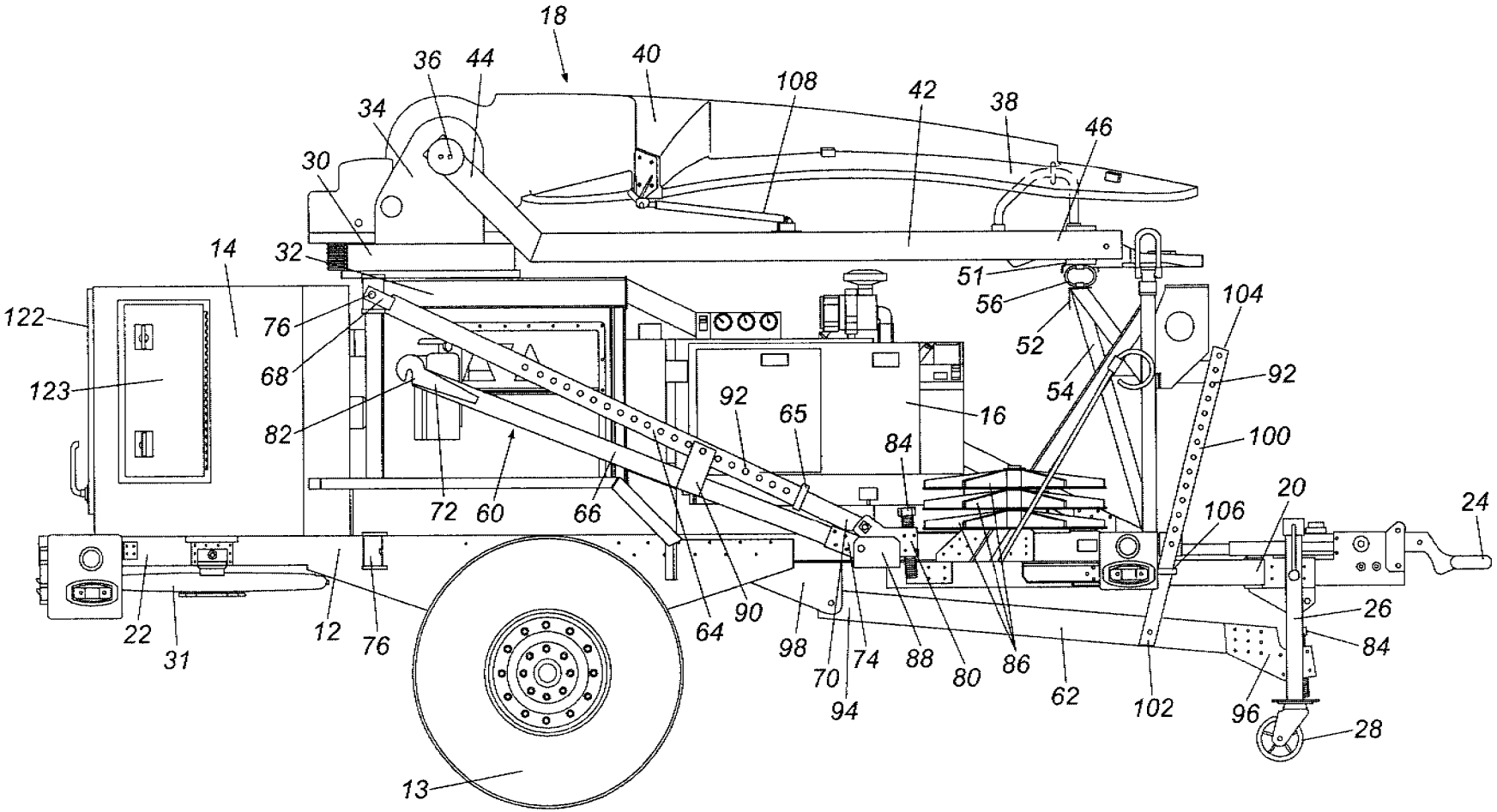
FIG. 3 is a right side elevation view of the mobile satellite trailer shown in FIG. 1.
Figure 8:
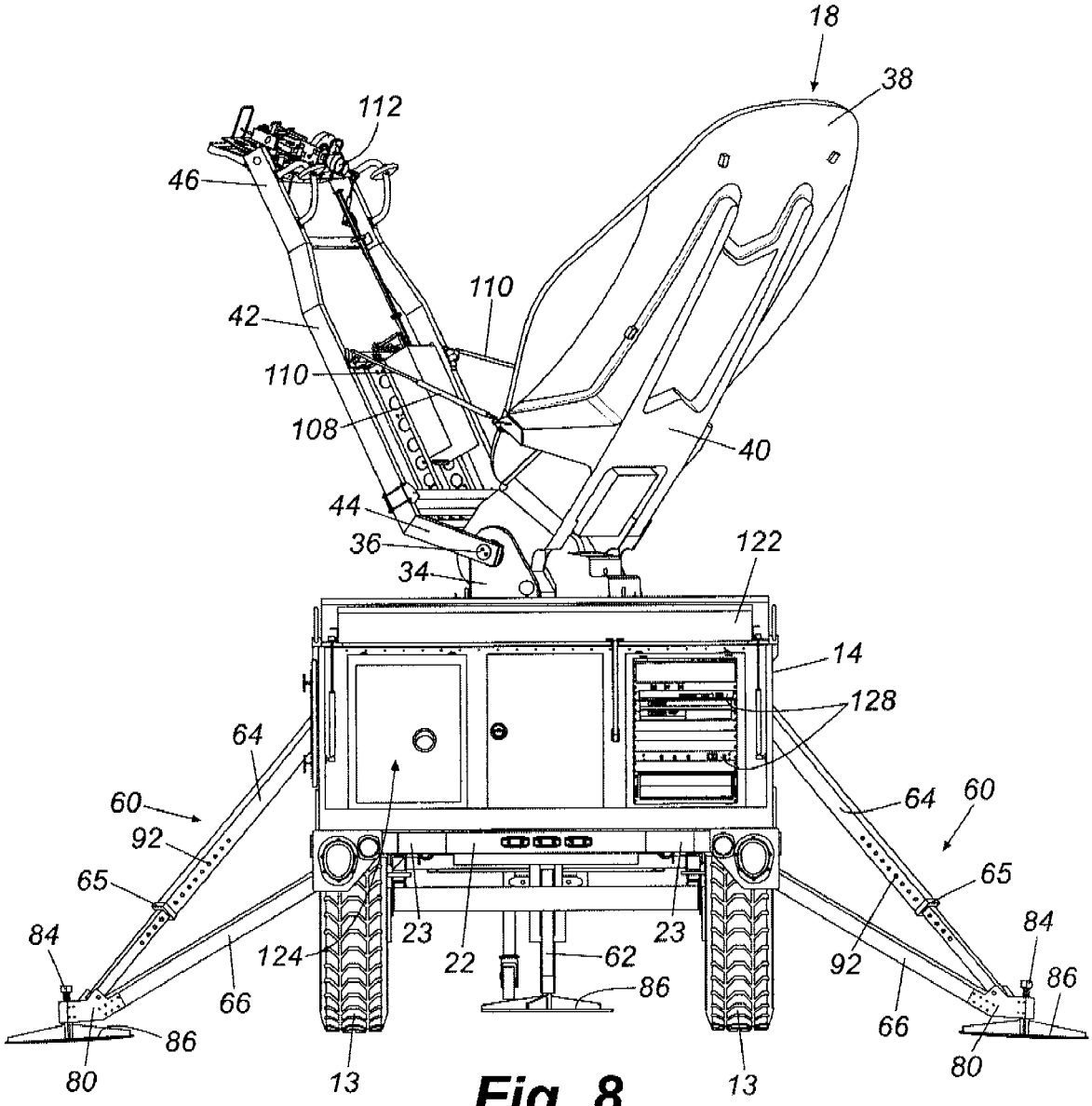
FIG. 8 is a rear perspective view of the mobile satellite trailer shown in FIG. 1.

Referring to the drawings, and particularly to FIGS. 1-3, a mobile satellite trailer 10 has a frame 12, two or more tires 13, an electronic equipment cabinet 14, a generator 16, a generator oil tank 11 (FIGS. 6 and 9) a generator fuel tank 15, a storage compartment 17 (FIGS. 6 and 9), a collapsible antenna assembly, generally denoted 18, and an antenna assembly motor (not shown). Frame 12 may be formed of aluminum, steel, or other suitable material and defines a tongue end 20 and a rear end 22 that defines two rear bumpers 23 (FIG. 8). Trailer tongue end 20 has a hitch 24 for connecting trailer 10 to a towing vehicle (not shown). Additionally, a tilt jack 26, outfitted with a caster 28, is attached to trailer frame tongue end 20.

Trailer 10 is typically operated in one of two modes: a transportation mode (FIGS. 1-5), where all components are securely fastened to the trailer so as to permit safe and easy transport behind a towing vehicle; and a transmission mode (FIGS. 6-9), where the trailer is securely supported to minimize the movement of the antenna during transmission.

Antenna assembly 18 includes a rotating antenna pedestal 30 (FIGS. 2 and 3), which is rigidly anchored to frame 12 by pedestal support 32. Pedestal 30 supports an antenna pedestal bracket 34 that defines an elevation angle pivot point 36. Assembly 18 also includes a parabolic reflector 38, supported by a reflector bracket 40, which is pivotally connected to elevation angle pivot point 36. Antenna assembly 18 further includes a feed 112 (FIG. 8) and a feed boom 42. Feed boom 42 defines two ends: a pivot end 44 that is pivotally connected to pedestal bracket 34 at pivot point 36, and a feed end 46 (FIGS. 2 and 3) distal from pedestal bracket 34, which supports the antenna feed.

Figure 4:
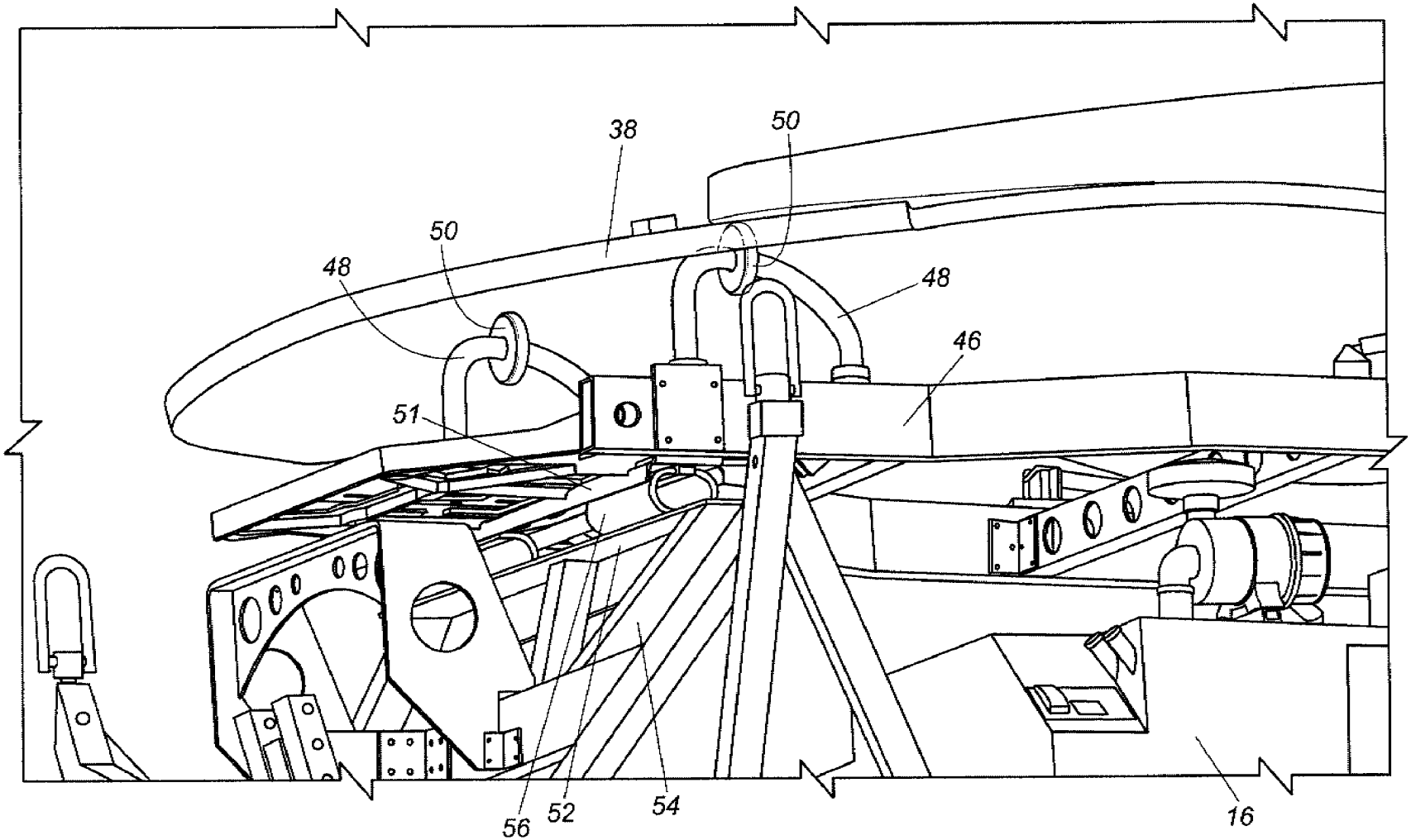
FIG. 4 is a detailed left perspective view of the mobile satellite trailer shown in FIG. 1.

Referring to FIG. 4, boom feed end 46 supports feed 112 (FIG. 8), and provides cushioned support for reflector 38 during transportation. Feed end 46 defines two U-shaped support brackets 48, each having a bumper 50 thereon. In the present embodiment, bumpers 50 are donut-shaped and made of a shock absorbing polymer. Those skilled in the art should understand that bumpers 50 may take on any one of many alternative shapes, such as cylindrical, oblong, rectangular, or triangular. Additionally, it should be understood that bumpers 50 may be a metallic spring with an elastomer sheath or a wire rope isolator interface or bumper 50 may be formed from any shock absorbing material, such as foam, polymer, plastic, rubber, or. One major descriptive characteristic of the bumpers is their value of hardness. "Hardness," as used herein, is a measure of the resistance of a cured material to withstand indention. Hardness may be measured by a durometer. As should be understood in this art, a durometer measures penetration depth into a material of a pin or drill applied to a surface of the material with a controlled, measured force. As should also be understood, hardness may be expressed in various scales, for example a Shore A scale for soft or elastic materials such as rubber or plastics and a Shore D scale for harder materials.

A Shore A durometer is used to measure the hardness of rubber parts by measuring the resistance force against a pin that penetrates the test material under a known spring load. The amount of penetration is converted to a hardness reading based on a scale having 100 Shore A units. Similarly, Shore D durometer is used to measure the hardness of plastic parts. The indentation hardness is inversely related to the penetration and is dependent on the modulus of elasticity and the viscoelastic properties of the material. The force applied, the shape of the indenter, and the duration of the test all affect the results. The Shore durometer consists of a reference presser foot, an indenter, an indicating device, and a calibrated spring that applies the force to the indenter. The difference between the type A and type D durometer is in the shape of the indenter and the calibrated spring, as indicated in the table below.

| Shore Durometer | Indenter | Applied force, F/mN |
|---|---|---|
| Type A | Hardened steel rod having a 1.10 mm-1.14 mm diameter, with a truncated 35° cone, 0.79 mm diameter. | $F = 550 + 75\ H_A$ |
| Type D | Hardened steel rod having a 1.10 mm-1.14 mm diameter, with a 30° conical point, 0.79 mm diameter. | $F = 445\ H_D$ |

The units of hardness range from 0 for the full protrusion of the 2.50 mm indenter to 100 for no protrusion. The force is applied as rapidly as possible, without shock, and the hardness reading is made after a duration of 15 s±1 s. If an instantaneous reading is specified, the scale is read within 1 second of the application of force.

Materials may have Shore A hardness values ranging from Shore A 20 for very soft materials increasing to Shore A 90 for harder materials. Shore D hardness values range from 30 to 85 where a material with Shore D 85 hardness would be considered very hard. The upper end of the Shore A scale overlaps with the lower end of the Shore D scale. For example, a typical pencil eraser has a Shore A hardness generally within a range of 25-30. A rubber sole of a shoe can be expected to have a shore A hardness generally within a range of 75-85 and a Shore D hardness generally within a range of 25-30. PVC tubing would have a Shore D hardness generally within a range of 75-85. Referring again to FIG. 4, bumpers 50 preferably have a hardness within a range of about 40 to 80 Shore A units, and in one preferred embodiment has a hardness within a range of about 65 to 75 Shore A units. During transportation, reflector 38 rests on bumpers 50, which ensure that reflector 38 is not damaged during transportation over rugged terrain.

Referring back to FIGS. 1-3, reflector 38 is secured in place by a brake mechanism (not shown) provided by antenna assembly motor, which prevents reflector 38 from rotating about elevation pivot point 36 during transportation. It should be understood by one skilled in the art that reflector 38 may be secured in a transport mode by other means, such as bolts, clips, clamps, cables, wires or any other suitable device that will lock reflector 38 against bumper 50.

In the transport mode, feed boom end 46 rests in a boom cradle 51 (FIG. 4) that is supported by a feed boom support ledge 52. Ledge 52 is rigidly connected to trailer frame 12 by a support truss 54, as depicted in FIGS. 2-4. Boom cradle 51 receives feed boom end 46 when antenna assembly 18 is placed in the transport mode, and cradle 51 is cushioned by a feed boom shock isolator 56, which is positioned atop support ledge 52. Feed boom shock isolator 56 diminishes the impact and jarring forces that may be transferred to feed boom 42 and reflector 38 through frame 12. In one embodiment, feed boom shock isolator 56 is a model WR12-400-08 wire rope isolator manufactured by Enidine, Inc. of Orchard Park, N.Y., but one of skill in the art should understand that shock isolator 56 may be a spring, a resilient elastomer, polymer, or other suitable material. Accordingly, boom cradle 51 and support ledge 52 support feed boom end 46, which, in turn, supports reflector 38 through bumpers 50. The cushioned support provided by bumpers 50 and shock isolators 56 ensures that both feed boom 42 and reflector 38 are protected from shocks and jarring during transportation.

Referring back to FIGS. 2 and 3, mobile satellite trailer 10 is further equipped with two collapsible rear stabilizing legs 60 and one front stabilizing leg 62. Rear stabilizing legs 60 have a telescoping upper member 64 and a fixed length lower member 66. Upper member 64 has a telescopic joint 65 and defines a first end 68 and a second end 70. Lower member 66 also defines a first end 72 and a second end 74 that is pivotally connected to upper member second end 70 by a joint 80. Upper member first end 68 is pivotally connected to the side of antenna pedestal support 32 by a hinge 76 that allows upper member 64 to pivot about both a vertical axis and a horizontal axis (not shown). Lower member first end 72 defines two spaced-apart slots 82 that engage a lower frame hinge 76 as described below.

Figure 5:
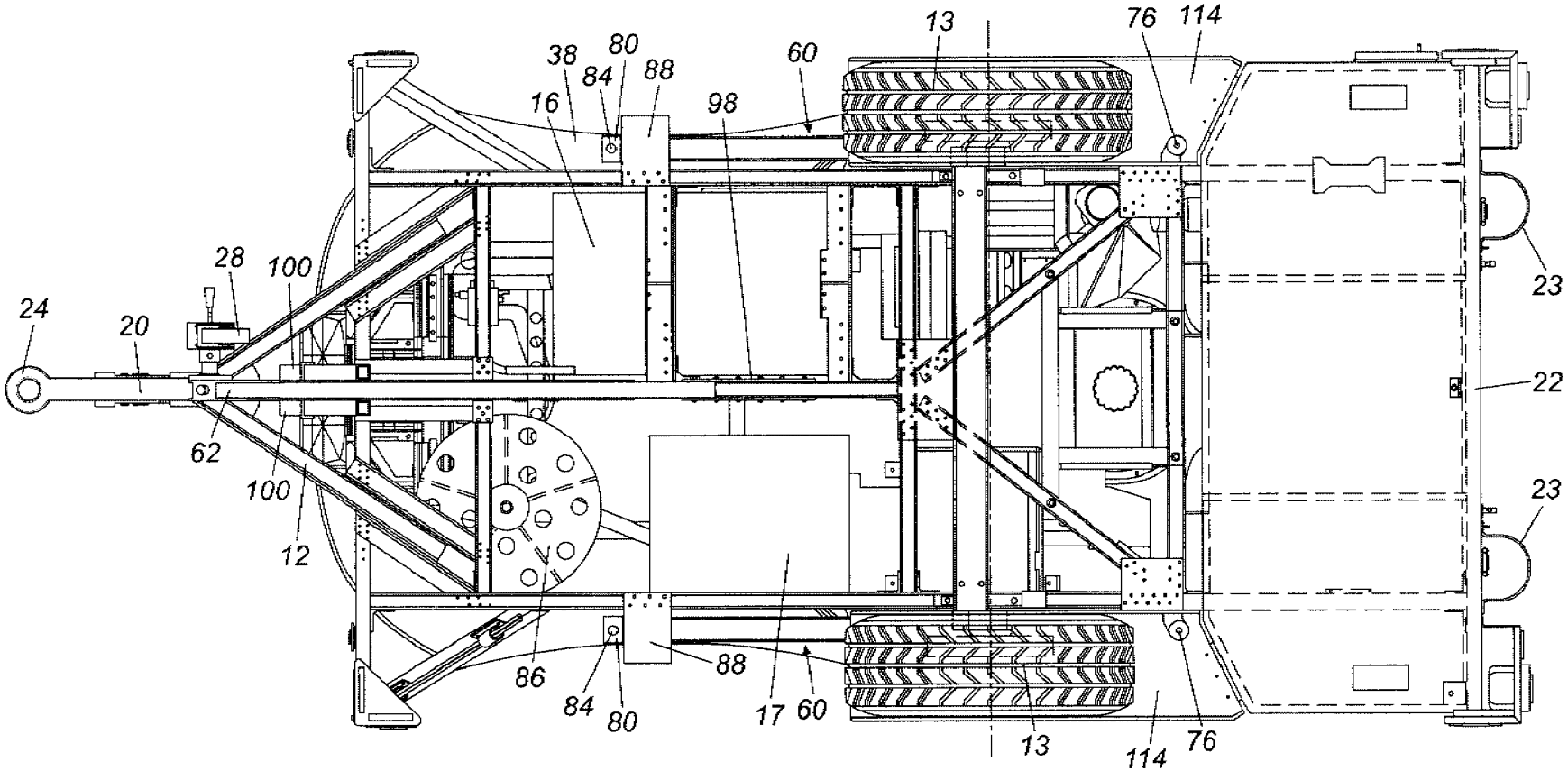
FIG. 5 is a bottom plan view of the mobile satellite trailer shown in FIG. 1.

Joint 80 allows for the articulated movement of the upper and lower members of rear stabilizing legs 60 so that the legs may be positioned in a manner that best supports mobile satellite trailer 10 on rugged or uneven terrain. Joint 80 also receives a foot adjustment bolt 84 that is used to attach a foot 86 to joint 80. Foot 86 is stowed on frame 12 during transportation as shown in FIGS. 2, 3 and 5. During transportation of trailer 10, rear stabilizing leg joints 80 are each held in place by a holding bracket 88 mounted on trailer frame 12, which prevents stabilizing legs 60 from swinging away from trailer frame 12. Additionally, a stabilizing leg clip 90 holds rear leg lower member 66 adjacent to and below rear leg upper member 64 by a pin connection to one of the multiple adjustment holes 92 formed in upper member 64. In this manner, rear stabilizing legs 60 are securely fastened against the trailer during transportation and will not inadvertently swing away from trailer frame 12 when traversing rugged terrain.

Front stabilizing leg 62 has a first end 94 that is pivotally connected to a front leg frame bracket 98 attached to an underside of trailer frame 12 at a position forward of pedestal support 32. Front stabilizing leg 62 further defines a front leg second end 96 that receives a foot adjustment bolt 84, which is used to attach the front leg second end 96 to a foot 86. Front leg 62 is further supported by front leg adjustment post 99 (FIG. 1) and two adjustable front support members 100 (FIG. 1). Support members 100 each define a first end 102 that is pivotally connected to front leg 62 intermediate front leg first end 94 and front leg second end 96. Referring to FIGS. 2 and 3, support members 100 each further define a second end 104 that is slidably received in a guide 106 attached to frame 12. Adjustment holes 92 are formed in each front support member 100, and corresponding adjustment holes (not shown) are formed in adjustment post 99. Front support members 100 are locked into place by inserting a pin 93 (FIGS. 6 and 9) through adjustment holes 92 of both support members 100 and adjustment post 99. In this way, front stabilizing, leg 62 is securely held in place and will not rotate away from trailer frame 12 during transportation.

Referring now to FIGS. 6-9, antenna assembly 18 is shown in a transmission mode. Reflector 38 and feed boom 42 are pivoted about elevation angle pivot point 36 so that the reflector points upward toward a satellite in geosynchronous orbit about the earth. Two cylinders 108, each having a piston rod 110, connect reflector 38 and feed boom 42. As reflector 38 pivots about pivot point 36, the cylinder piston rods 110 rotate the boom with respect to the reflector until fully extended. Full extension of cylinder piston rods 110 ensures that reflector 38 and feed boom 42 are positioned at a fixed angle determined by the location of the focal point of reflector 38 regardless of the elevation angle the reflector. Proper transmission requires that feed 112 (FIGS. 8 and 9), which is attached to boom feed end 46, be positioned at the focal point of reflector 38. Pedestal 30 also pivots to allow antenna assembly 18 to rotate about an axis of rotation (not shown) in order to achieve the proper azimuth angle. Adjustment of the azimuth and elevation angles allows antenna assembly 18 to focus on a particular satellite.

Figure 9:
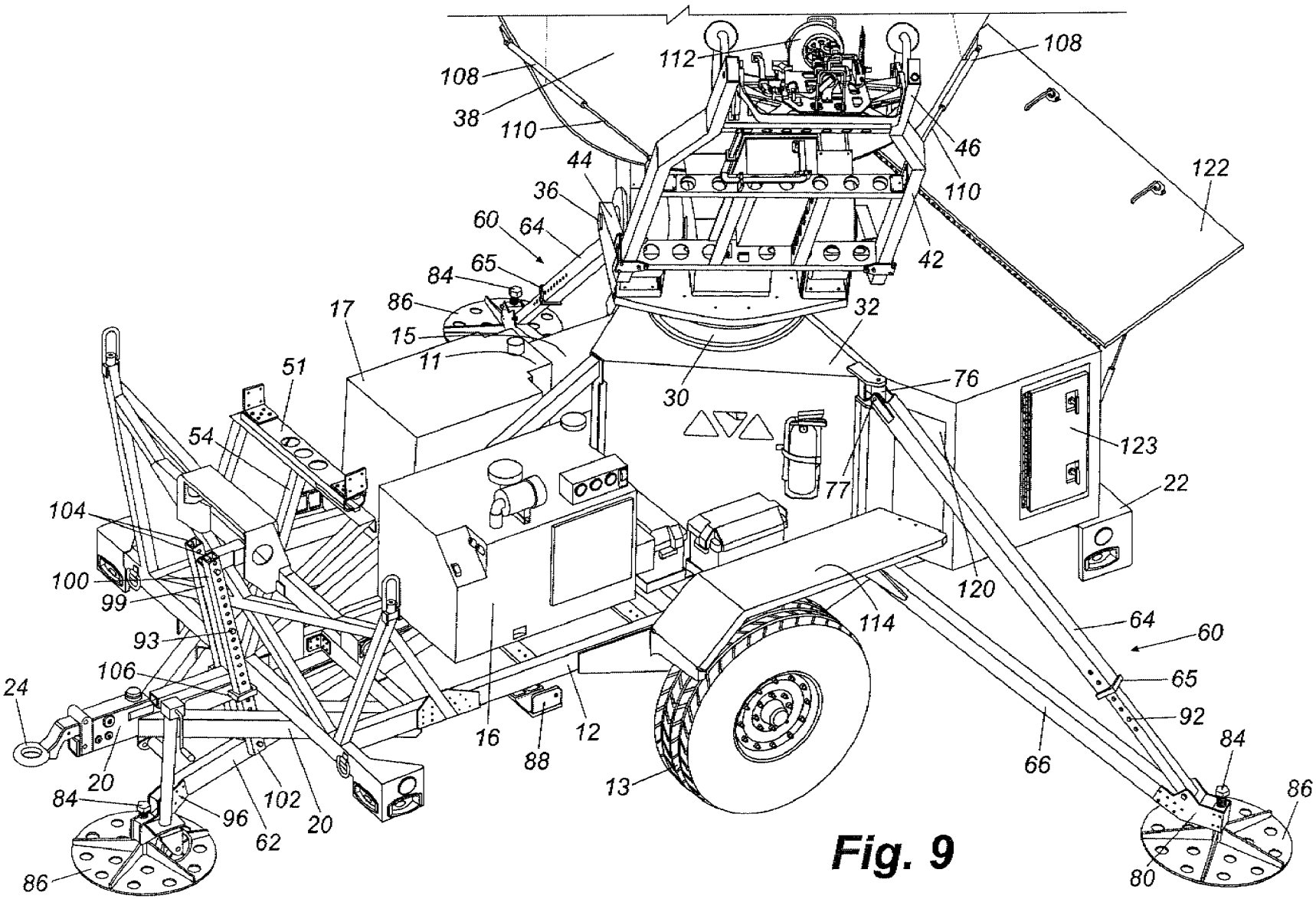
FIG. 9 is a partial perspective view of the mobile satellite trailer shown in FIG. 1.

During transmission, rear stabilizing legs 60 are positioned to securely and rigidly support antenna pedestal 30. A scissor jack 31 lifts trailer rear end 22 so that trailer frame 12 is leveled and the trailer's weight is no longer supported by the suspension (not shown) and tires 13. The pivotal rotation of hinge 76 about the hinge's axis of rotation (not shown) allows rear leg upper support member 64 to swing out and away from frame 12. With particular reference to FIG. 9, rear leg 60 also pivots about a hinge pin 77 (FIGS. 6 and 9), which allows rear leg 60 to be positioned such that joint 80 and foot adjustment bolt 84 may be brought into close proximity with the ground, and foot 86 is releasably attached to bolt 84. The length of rear stabilizing leg upper member 64 may be adjusted by using telescopic joint 65 to extend upper member 64 to the appropriate length. Adjusting the length of upper support members 64 allows the frame rear end 22 to be leveled regardless of the grade of the ground.

Figure 13A:
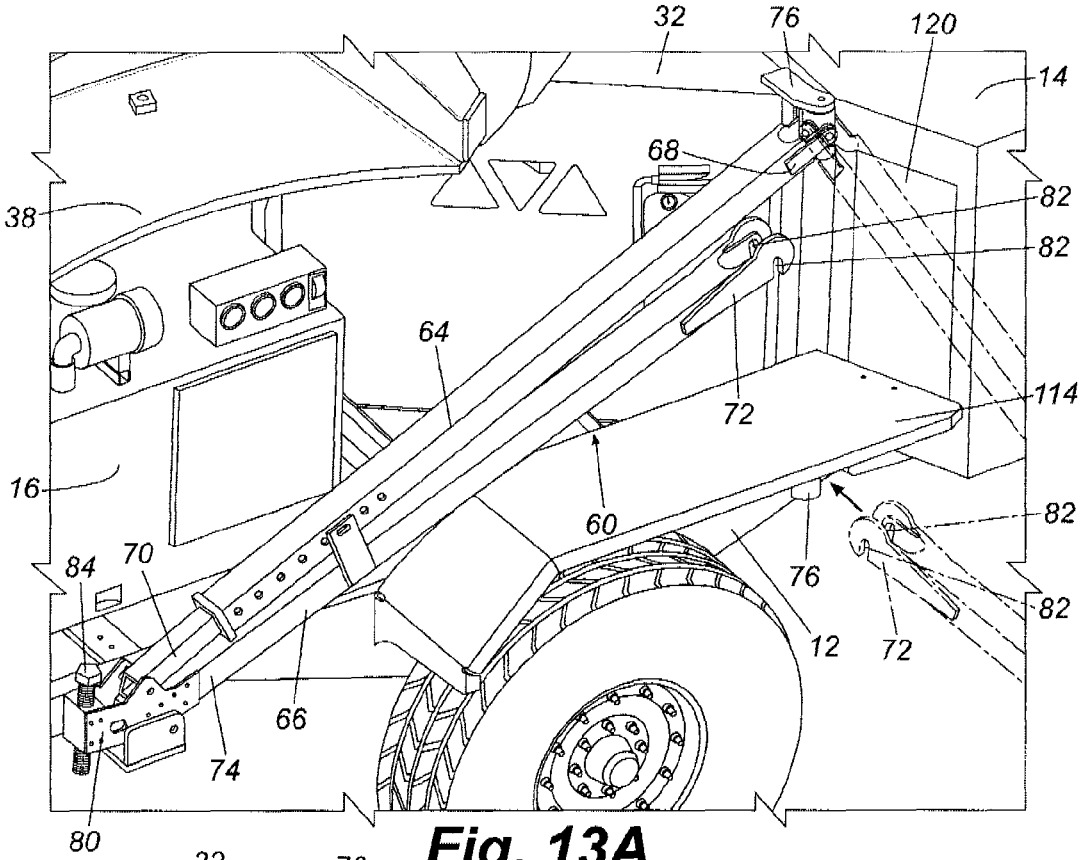
FIGS. 13A and 13B are partial left perspective views of the mobile satellite trailer shown in FIG. 1.
Figure 13B:
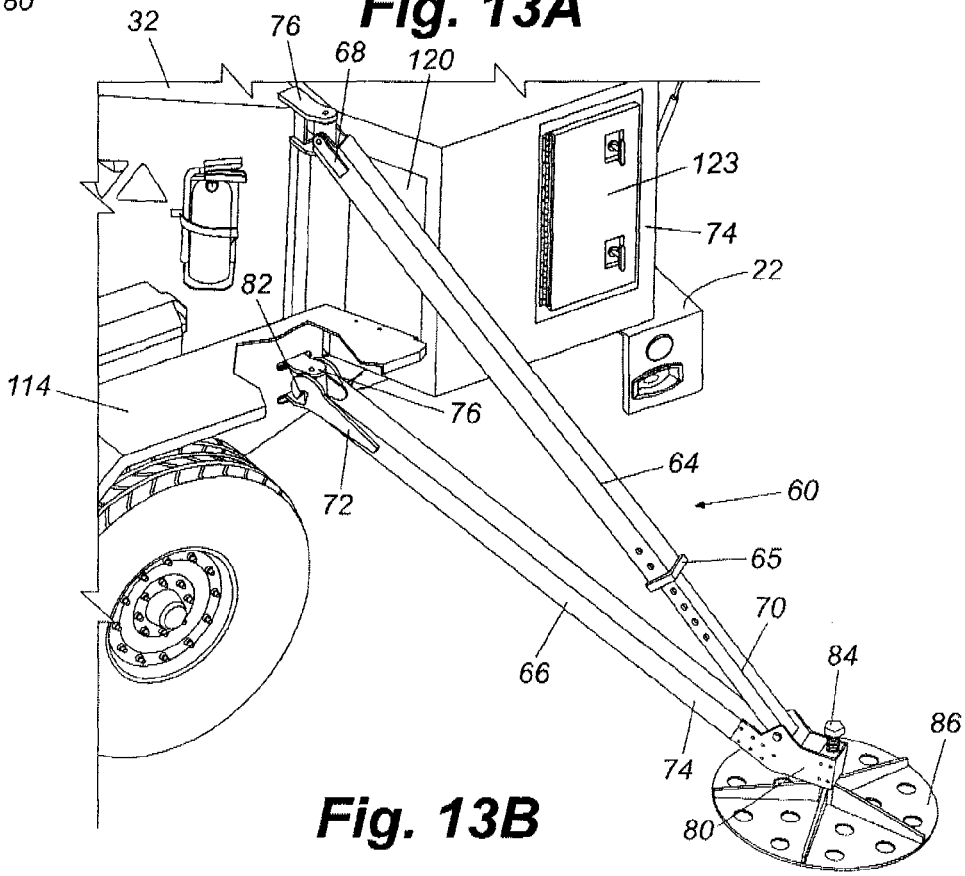

Turning now to FIGS. 13A and 13B, rear stabilizing leg lower members 66 are connected to frame 12 under a fender 114 to lock rear stabilizing leg 60 into place. Slots 82 formed in lower member first end 72 slidably receive a pin (not shown) attached to lower frame hinge 76 (FIG. 14B). The cooperation between slots 82 and the pin attached to frame hinge 76 allows for quick assembly and teardown of the trailer from the transmission mode. After attaching lower member first end 72 to lower hinge 76, rear stabilizing leg telescopic joint 65 is adjusted to bring foot 86 into close proximity with the ground. A pin (not shown) is inserted through the appropriate rear stabilizing leg adjustment holes 92 to securely lock rear stabilizing legs 60 into the desired position, and foot adjustment bolt 84 is adjusted to ensure that trailer frame rear end 22 is level and arranged in the proper attitude for transmission. Once rear stabilizing legs 60 are adjusted to level trailer rear end 22 and provide stable support for antenna pedestal 30, scissor jack 31 is removed.

Referring back to drawings 6, 8, and 9, front stabilizing leg 62 is shown lowered so that front leg second end 96 may securely and rigidly support antenna pedestal 30. Tilt jack 26 (FIGS. 1, 2 and 3) is used to raise trailer tongue end 20 to an appropriate height so that the trailer is maintained in a level position. Foot 86 is then releasably attached to foot adjustment bolt 84 located at front leg second end. Front stabilizing leg support members 100 slide in their respective guides 106 and are secured in place by inserting pin 93 through adjustment holes 92 formed in both support members 100 and adjustment post 99. Foot adjustment bolt 84 is then used to adjust foot 86 so that trailer frame front end 22 is level and arranged in the proper attitude for transmission.

Adjusting rear stabilizing legs 60 and front stabilizing leg 62 will securely position mobile satellite trailer 10 on the ground. Incremental adjustment of rear stabilizing legs 60 and front stabilizing leg 62 will allow operators or other personnel to achieve the proper balance and attitude for the trailer 10. When fully supported by rear stabilizing legs 60 and front stabilizing leg 62, the weight of trailer 10 is removed from tires 13 and placed entirely on rear stabilizing legs 60, and antenna 18 is rigidly positioned with respect to the ground and isolated from external forces and vibrations.

Figure 6:
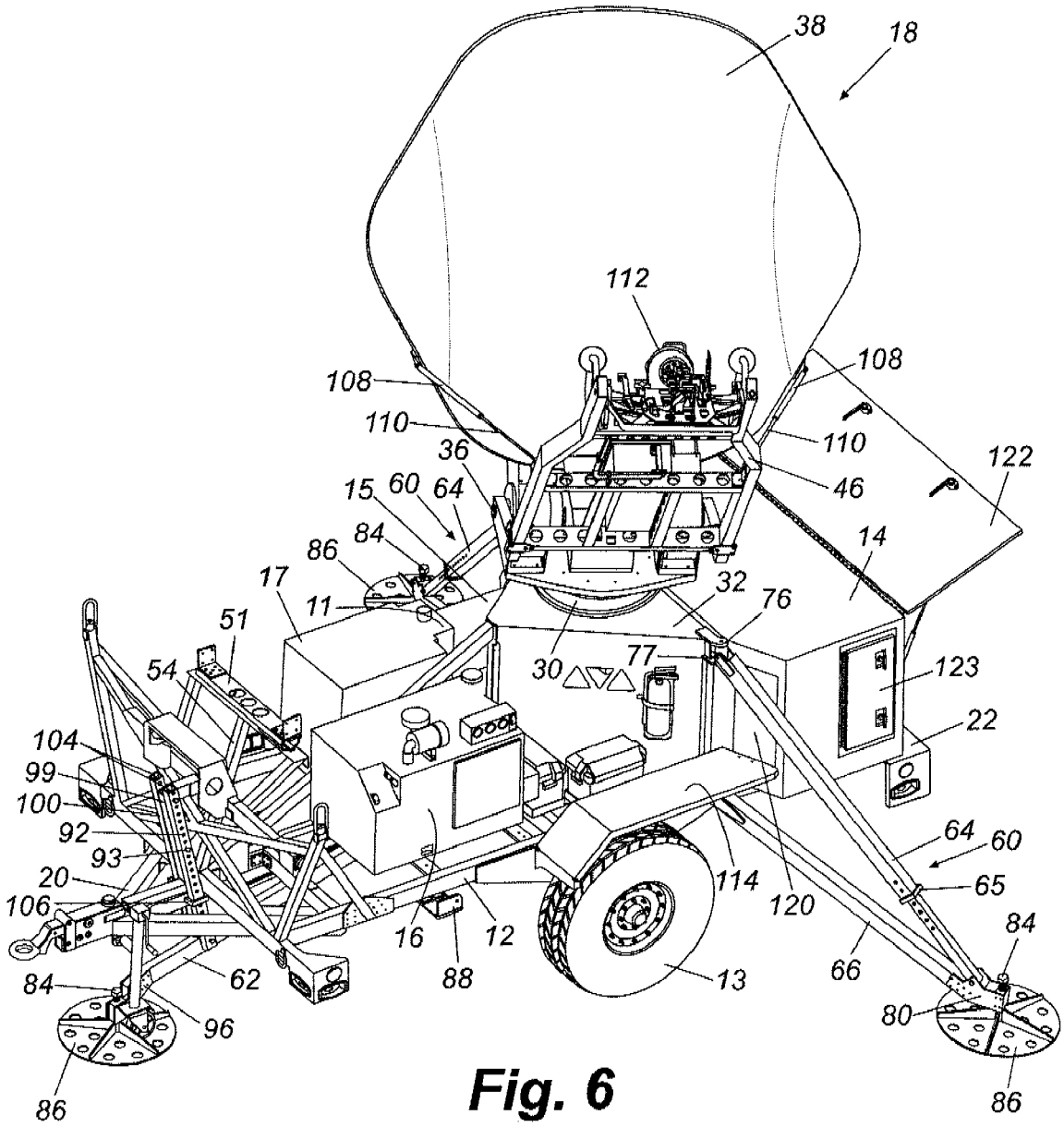
FIG. 6 is a perspective view of the mobile satellite trailer shown in FIG. 1 illustrated in a transmission mode.
Figure 7:
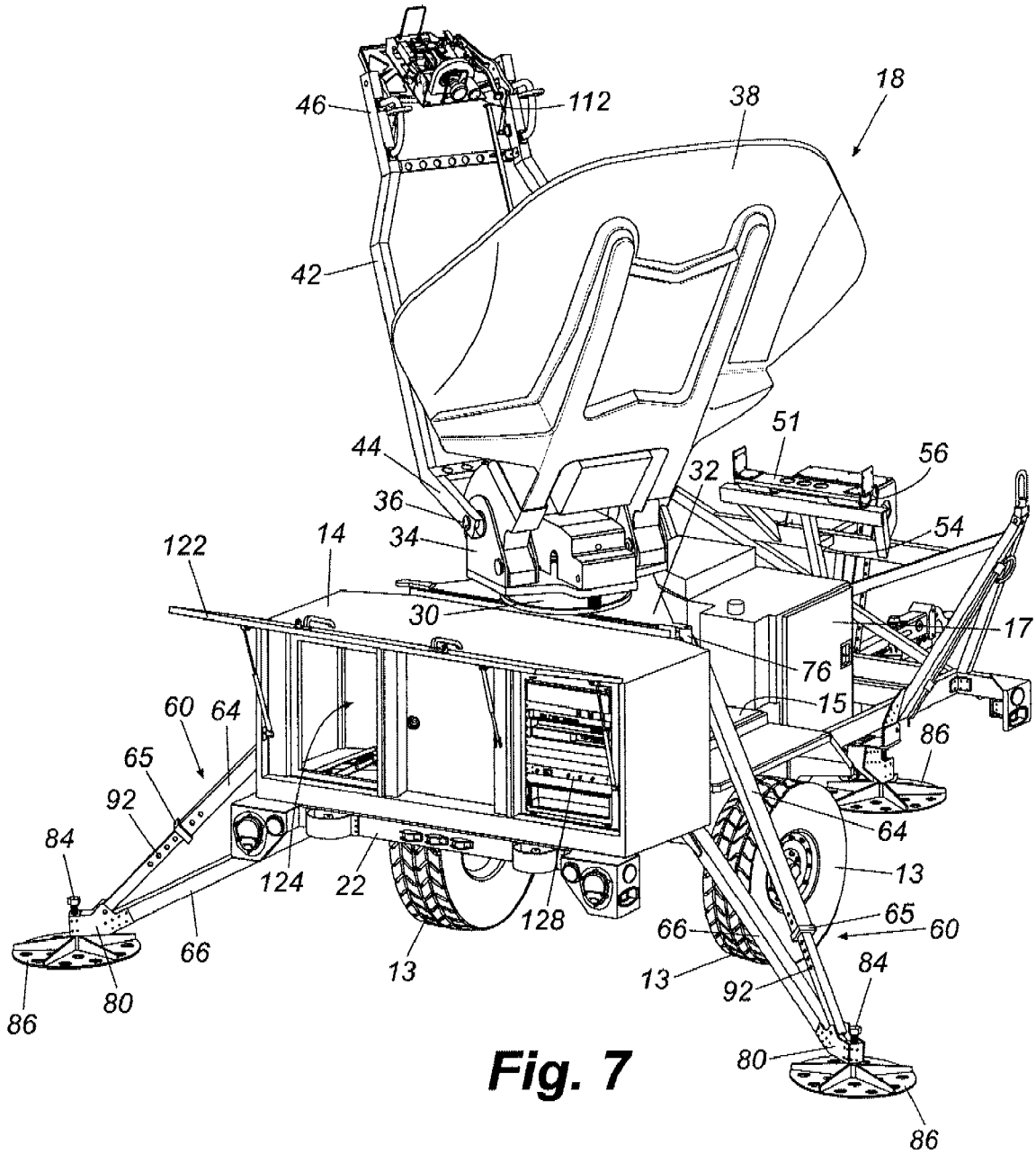
FIG. 7 is a rear perspective view of the mobile satellite trailer shown in FIG. 1.

Referring back to FIG. 1, electronics cabinet 14 is located at the rear of trailer 10, behind antenna pedestal support 32. Referring to FIGS. 6, 7, and 8, the interior of electronic equipment cabinet 14 is accessible through either a cabinet side door 120 (FIG. 6) or the rear main door 122, shown in an open position. Additionally, a breaker panel (not shown) is accessible through breaker panel access door 123 (FIG. 6).

Figure 10:
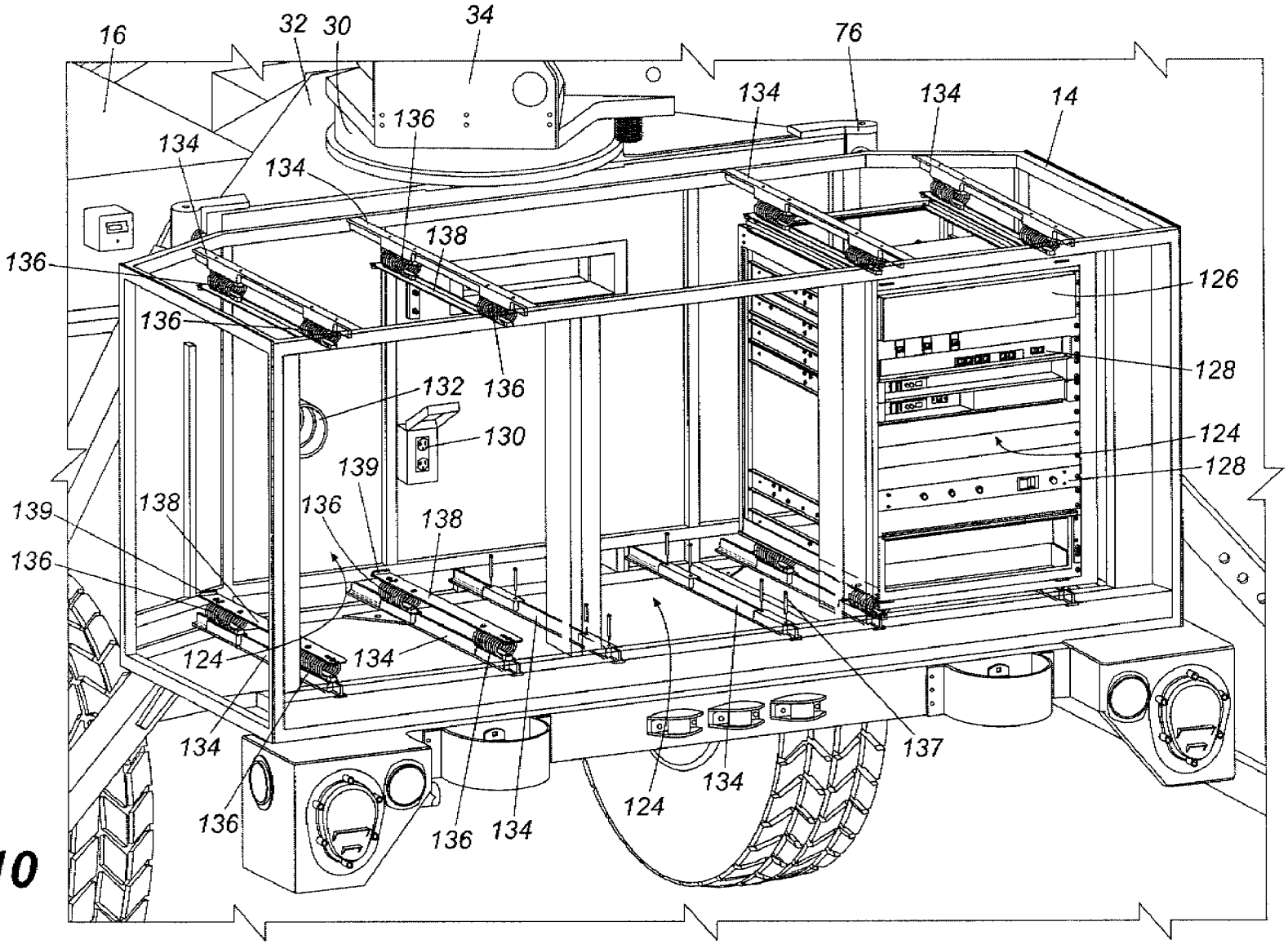
FIG. 10 is a detailed rear view of the mobile satellite trailer shown in FIG. 1.

Referring now to FIG. 10, equipment cabinet 14 is shown without any of its outer sheet metal or doors. Cabinet 14 has three bays 124 that may be used to house a unitary electronics rack 126 or other equipment. Unitary rack 126 supports electronic components 128 external to antenna feed 112 (FIG. 8) such as amplifiers, decoders, communications hubs, and other communications hardware. Cabinet 14 also provides an electrical outlet 130 for connecting external equipment and a portal 132 that allows various cables, patch cords, power supply cords from generator 16 and other connection lines (not shown) to pass in to and out of cabinet 14. Cabinet 14 is supported by a plurality of cross members 134 that provide additional structural rigidity. Typically, cross members 134 are situated such that two members 134 cross the top and bottom of each bay 124. Each cross member is equipped with multiple shock absorbers 136 that support a mounting rail 138. Shock absorbers 136 are fastened to cross members 134 by fasteners 137. Each mounting rail 138 slidably receives a corner of unitary component rack 126, and rail stop 139 locates rack 126 properly on rails 138. Once properly positioned on rails 138, unitary rack 126 may be securely fastened to mounting rails 138 by clips, detents, pins, cap screws or other fasteners. Mounting rails 138 and shock absorbers 136 isolate unitary electronics rack 126 from any jarring or vibration forces imparted on trailer 10.

Figure 11:
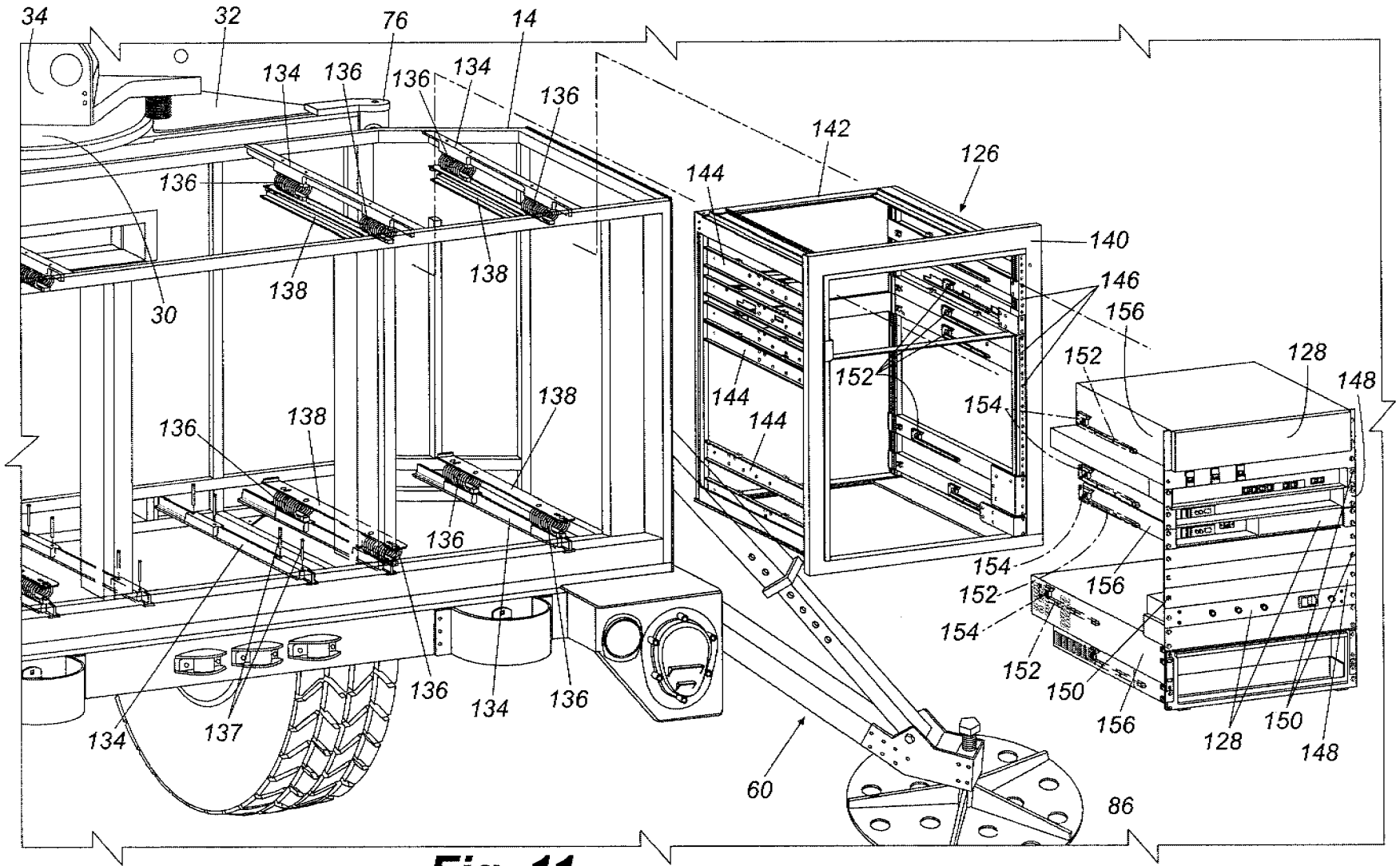
FIG. 11 is a partial rear exploded perspective view of the mobile satellite trailer shown in FIG. 1.

Referring to FIG. 11, which shows an exploded view of electronics equipment cabinet 14, unitary electronic component rack 126 is shown with electronic components 128 removed. Unitary rack 126 defines a rack front 140, a rack rear 142 and a plurality of horizontal side members 144 connected to both rack front 140 and rack rear 142. Rack front 140 provides a plurality of front mounting points 146, which may be tapped or through holes that are sized appropriately to receive a fastener 147 (FIG. 12), such as a cap screw or shoulder bolt. Typical rack-mounted electronic components 128 are equipped with a front face plate 148 having a plurality of mounting holes 150 sized similarly to front mounting points 146. Fasteners 147 (FIG. 12) are inserted through both electronic component front face plate mounting holes 150 and the corresponding unitary rack front mounting points 146 so as to securely fasten components 128 to unitary electronics rack front 126.

Each rack side member 144 defines a rear support track 152 that slidably receives a slider 154 affixed to a side panel 156 of each electronic component 128. Slider 154 is typically attached to electronic component side panel 156 by a screw or other appropriate fastener and may be fashioned out of DERLIN® or other polymer that allows for smooth sliding such as TEFLON®, or Urethane. As an electronic component 128 is installed into unitary equipment rack 126, track 152 slidably receives slider 154. When component 128 is fully inserted into rack 126, track 152 locks slider 154 in place to rigidly secure the rear portion of component 128 into rack 126. Track 152 may be machined to tight tolerances with a decreasing width so that slider 154 is compressed as it slides further into track 152. Furthermore, track 152 may also have a shape that releasably receives slider 154, such as a sideways J-shape, as shown in FIG. 11. It should be understood by those of skill in the art that track 152 may take on any shape that promotes locking engagement between track 152 and slider 154 such as a C-shaped track.

FIG. 11 depicts an engagement between slider 154 and track 152, shown in phantom at the rear of electronic components 128. Thus, the cooperation between rear support tracks 152 and sliders 154 secures the rear portion of electronic components 128 and minimizes the stress imparted upon component front face plates 148 during transportation. Securing both the front and rear of each component 128 also minimizes the movement of components 128 relative to each other and to rack 126, thereby creating a unitary structure.

Figure 12:
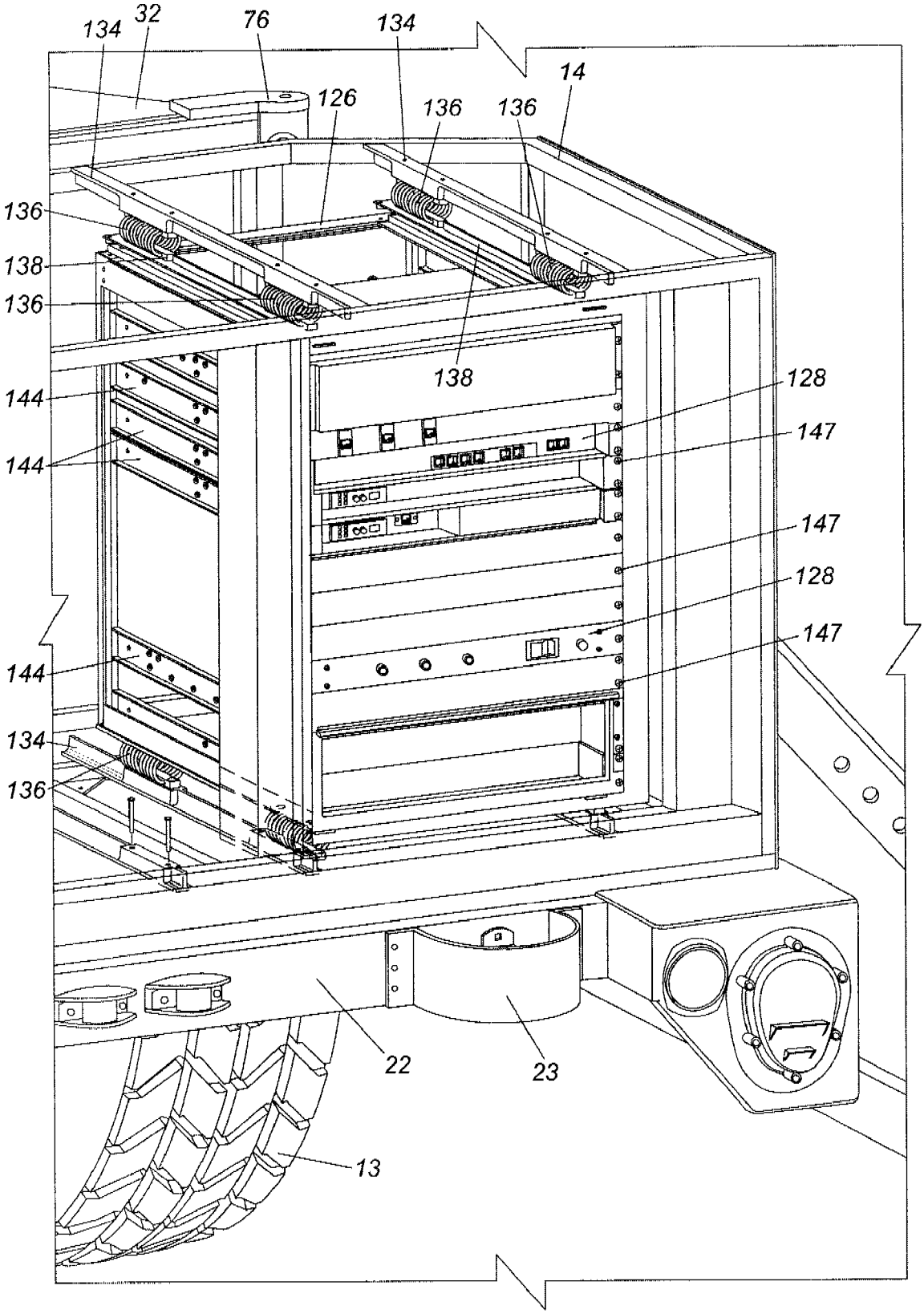
FIG. 12 is a partial rear perspective view of the mobile satellite trailer shown in FIG. 1.

Referring to now to FIG. 12, once electronic components 128 are installed in unitary electronics rack 126, and fasteners 147 have been installed to secure component front face plates 148 to rack front 140 (FIG. 11), rack 126 may be installed as a single module into electronics cabinet 14. As previously described, mounting rails 138 slidably receive the corners of rack 126, and rack 126 may be secured to rails 138 by clips, detents, or fasteners (not shown). In this arrangement, when trailer 10 traverses a bump, shock absorbers 136 dampen out the shock imparted upon the unitary electronics rack 126. As mentioned above, components 128 will not move relative to each other or relative to rack 126. This arrangement provides a shock absorbing feature for unitary rack and components 128 as a unitary module, rather than providing shock absorbing devices for each individual component 128.

While one or more preferred embodiments of the invention have been described above, it should be understood that any and all equivalent realizations of the present invention are included within the scope and spirit thereof. The embodiments depicted are presented by way of example and are not intended as limitations upon the present invention. Thus, those of ordinary skill in this art should understand that the present invention is not limited to the embodiments disclosed herein since modifications can be made.

What is claimed is:

1. A mobile satellite communication trailer, said trailer comprising:

a. a frame defining a trailer front portion and a trailer rear portion, wherein said frame is coupled to a plurality of wheels, b. a satellite antenna assembly coupled to said frame and moveable between a transmission position and a transport position, and c. at least three adjustable stabilizing legs providing rigid support for said antenna assembly when said antenna assembly is in said transmission position by lifting said plurality of wheels off the ground when in said transmission position, wherein one of said at least three adjustable stabilizing legs is moveably connected to said trailer front portion and engages the ground when in said transmission position; and at least two of said at least three adjustable stabilizing legs are pivotally connected to at least one of said satellite antenna assembly and said trailer frame adjacent said satellite antenna assembly and engages the ground when in said transmission position.

2. The mobile satellite communication trailer of claim 1, wherein said at least two of said at least three adjustable stabilizing legs are pivotally connected to both said satellite antenna assembly and said frame.

3. The mobile satellite communication trailer of claim 1, wherein said at least two of said at least three adjustable stabilizing legs are pivotally connected to said satellite antenna assembly and releasably connected to said frame.

4. The mobile satellite communication trailer of claim 1, further comprising an electronics cabinet mounted at said trailer rear portion, said electronics cabinet further comprising a. a frame, b. at least one equipment rack removably received said electronics cabinet frame, and c. at least one shock absorber intermediate said electronics cabinet frame and said at least one equipment rack.

5. The mobile satellite communication trailer of claim 4, wherein said at least one electronics cabinet shock absorber is a spring.

6. The mobile satellite communication trailer of claim 4, wherein said at least one equipment rack receives at least one electronic equipment component, wherein said at least one electronic equipment component is releasably attached to said at least one equipment rack at least two of a front face, side face and back face of said at least one electronic equipment component.

7. The mobile satellite communication trailer of claim 6, wherein said at least one electronic equipment component is secured to said frame along said side face and said front face of said at least one electronic equipment component.

8. The mobile satellite communication trailer of claim 1, said satellite antenna assembly further comprising:

a feed boom, a reflector dish coupled to said feed boom, and at least one bumper coupled to said feed boom intermediate said feed boom and said reflector dish so that said bumper protectively engages said reflector dish when said antenna assembly is in said transport position.

9. The mobile satellite communication trailer of claim 8, wherein said feed boom comprises at least one bracket that receives said at least one bumper, said bracket extending from said feed boom toward said reflector dish.

10. The mobile satellite communication trailer of claim 8, wherein said at least one bumper is generally doughnut-shaped.

11. The mobile satellite communication trailer of claim 8, wherein said at least one bumper is formed from an elastomer material.

12. The mobile satellite communication trailer of claim 8, wherein said at least one bumper has a hardness of between 50 and 80 Shore A units.

13. The mobile satellite communication trailer of claim 12, wherein said at least one bumper has a hardness of between 65 and 75 Shore A units.

14. The mobile satellite communication trailer of claim 8, further comprising a plurality of bumpers positioned intermediate said feed boom and said reflector dish.

15. The mobile satellite communication trailer of claim 8, further comprising a shock isolator positioned intermediate said frame and said feed boom.

16. A mobile satellite communication trailer, said trailer comprising:

a. a frame coupled to a plurality of wheels, b. a satellite antenna assembly coupled to said frame and moveable between a transmission position and a transport position, and c. three adjustable stabilizing legs providing rigid support for said antenna assembly when said antenna assembly is in said transmission position by supporting the weight of said communication trailer, wherein at least two of said at least three adjustable stabilizing legs have a first end that is pivotally coupled to said satellite antenna assembly and said frame and a second end that engages with the ground.

17. The mobile satellite communication trailer of claim 16, wherein said at least two of said at least three adjustable stabilizing legs are releasably connected to said frame.

18. A mobile satellite communication trailer, said trailer comprising:

a. a frame coupled to a plurality of wheels, b. a satellite antenna assembly coupled to said frame and moveable between a transmission position and a transport position, said satellite antenna assembly comprising a feed boom, a reflector dish coupled to said feed boom, and at least one bumper coupled to said feed boom intermediate said feed boom and said reflector dish so that said bumper protectively engages said reflector dish when said antenna assembly is in said transport position, and c. three adjustable stabilizing legs providing rigid support for said antenna assembly when said antenna assembly is in said transmission position by supporting the weight of said communication trailer by lifting said plurality of wheels off the round, wherein at least two of said at least three adjustable stabilizing legs are pivotally coupled to said satellite antenna assembly and said frame.

19. The mobile satellite communication trailer of claim 18, further comprising a plurality of bumpers positioned intermediate said feed boom and said reflector dish.

20. The mobile satellite communication trailer of claim 18, further comprising a shock isolator positioned intermediate said frame and said feed boom.

* * * * *